United States Patent [19]

Gernhardt et al.

[11] 4,372,754

[45] Feb. 8, 1983

[54] IGNITION SYSTEM FOR COAL GASIFIER

[75] Inventors: Paul Gernhardt; Wilhelm Danguillier; Karl Peter, all of Bochum; Wolfgang Grams, Herne; Siegfried Pohl; Peter Schnitzler, both of Bochum, all of Fed. Rep. of Germany

[73] Assignees: Dr. C. Otto & Comp. G.m.b.H., Bochum; Saarbergwerke Aktiengesellschaft, Saarbrucken, both of Fed. Rep. of Germany; a part interest

[21] Appl. No.: 97,593

[22] Filed: Nov. 26, 1979

Related U.S. Application Data

[63] Continuation-in-part of Ser. No. 959,819, Nov. 13, 1978, abandoned.

[51] Int. Cl.[3] ..... C10J 3/68

[52] U.S. Cl. ..... 48/77; 48/87; 48/DIG. 2; 110/165 R; 110/266

[58] Field of Search ..... 48/DIG. 2, 62 R, 77, 48/87, 180 F, 92, 76; 431/186, 189, 258; 266/236, 240, 197; 110/165 R, 266

[56] References Cited

U.S. PATENT DOCUMENTS

| | | | |
|---|---|---|---|
| 2,285,704 | 6/1942 | Frank | 431/186 |
| 3,782,884 | 1/1974 | Shumaker | 431/186 |
| 3,907,340 | 9/1975 | George | 431/189 |
| 4,073,627 | 2/1978 | Anderson | 48/DIG. 2 |

FOREIGN PATENT DOCUMENTS

| | | | |
|---|---|---|---|
| 1148686 | 4/1969 | United Kingdom | 431/258 |

*Primary Examiner*—S. Leon Bashore
*Assistant Examiner*—Michael L. Goldman
*Attorney, Agent, or Firm*—Thomas H. Murray; Clifford A. Poff

[57] ABSTRACT

An ignition burner and a pilot burner form part of an ignition system for a fluidized stream of finely-divided coal particles in a pressurized gasifier housing having a slag overflow pipe coupled to a discharge vessel. A fuel supply pipe delivers fuel for combustion by the ignition burner and the pilot burner. A sparkplug or hot wire is used to ignite the fuel delivered to the ignition burner. The flame produced by the ignition burner is widened by a baffle so that ignition by the pilot burner occurs to produce a flame which is monitored through a thermocouple. The parts forming the ignition system are carried by a pair of levers with pivots on the inner wall of a slag overflow pipe for movement between an operative position wherein the ignition burner is situated near the slag-receiving opening of the overflow pipe and an inoperative position wherein the ignition burner is protected from contact by slag and radiation heating. The ignition burner moves within substantially only one plane extending through the centerline of said slag overflow pipe.

9 Claims, 7 Drawing Figures

IGNITION SYSTEM FOR COAL GASIFIER

CROSS-REFERENCE TO RELATED APPLICATION

This application is a continuation-in-part of application Ser. No. 959,819, filed Nov. 13, 1978 now abandoned.

BACKGROUND OF THE INVENTION

This invention relates to an ignition system for a fluidized stream of finely-divided coal particles in a pressurized gasifier housing wherein a pipe extending into the gasifier housing is employed for an overflow slag discharge.

In the process of high pressure gasification, fuel in the form of fine particles or dust is fed together with gasifying agents as a fluidized stream toward the bottom of a reaction chamber for gasification at temperatures of up to 2200° C. according to known gasifier constructions. Fluidized streams are formed by a plurality of main burners extending preferably tangentially and obliquely downwards toward the bottom of the reaction chamber. The gases produced are withdrawn from the top of the gasifier. Liquid slag in the bottom of the gasifier drips into a water bath where the slag granulates and undergoes discharge by way of lock systems.

To obtain the optimum operating temperatures in the gasification chamber, it is initially heated with gas. The main burners can be used for the gas supply in this case. It is known prior art to include the provision of ignition systems on the main burners to insure reliable ignition of relatively large amounts of gas.

Conventional ignition systems of this type do not withstand conditions within the environment of the gasification chamber and a specific ignition burner intended, for example, for the ignition of gas cannot be changed for the ignition of a jet stream of coal/oxygen.

Upon ignition and start-up of such pressurized gasifiers, a number of different operational states are passed through in a continuous manner before a steady-state operation is attained. It is desirable to heat up the reaction chamber while in an unpressurized state by means of one fuel, e.g., gas or oil, and then change over to the use of a fluidized stream of coal feedstock without the necessity for outside operations to effect the changeover operation. For example, the changeover operation should be carried out without the removal and fitting of parts in the reaction chamber of the gasifier.

SUMMARY OF THE INVENTION

It is an object of the present invention to provide an ignition system to withstand the operating conditions within a high pressure gasification chamber.

It is a further object of the present invention to alleviate the disadvantages and shortcomings of known ignition systems enumerated hereinbefore.

More specifically, according to the present invention, there is provided an ignition system for a fluidized stream of finely-divided coal particles in a pressurized gasifier housing having an elongated slag overflow pipe coupled to a discharge vessel, the ignition system including the combination therewith of an ignition burner extending into the slag overflow pipe, a pilot burner supported to ignite the ignition burner, fuel supply pipe means to deliver fuel for combustion by the ignition burner and the pilot burner, ignition means to ignite fuel delivered by the fuel supply pipe to the pilot burner, and support levers supported from the slag overflow pipe by pivots extending transversely to the extended length thereof, the support levers carrying the ignition burner, the ignition means, the fuel supply pipe and the pilot burner within the slag overflow pipe for movement between an operative position wherein the ignition burner is situated near the slag-receiving opening of the slag overflow pipe and an inoperative position wherein the ignition burner is protected from contact by slag and radiation heating.

Thus, according to the present invention, there is provided an ignition system for a fluidized stream of finely-divided coal particles, e.g., coal dust, for gasification in a pressurized gasifier housing wherein a pipe extending therefrom forms a slag overflow to discharge slag passed into the opening of the pipe into a vessel, the ignition system including an ignition burner, an ignition means, a fuel supply pipe and a pilot burner disposed within the slag discharge pipe so as to be adjustable by means situated externally of the pressurized housing between an operative position in which the ignition burner is situated near the aperture in the slag discharge pipe and an inoperative position in which the system is adequately protected from the flow of slag and heat due to radiation. In the preferred form, the ignition system is movably positioned by levers about pivot shafts extending transversely to the extended length of the slag discharge pipe and the flow of slag therein. The pivot shafts are situated on the inner wall of the slag discharge pipe. One of the shafts is extended for actuating adjustment by means situated outside the gasifier while a pressure-tight mechanical connection is provided for the parts extending through the wall of the slag overflow pipe. The ignition burner itself consists of two burners, a small pilot burner provided with ignition means, i.e., a sparkplug, preferably a hot-wire plug, and the actual ignition burner. A flame monitoring system, e.g., a thermocouple, is used to monitor the flame from the pilot burner. A flanged cover is affixed in a pressure-tight relation to the slag overflow pipe for external passage of the fuel supply pipe, the connecting lead for the ignition means and the flame monitor.

The pipe carrying the fuel gas to the ignition burner may include a baffle at the end thereof. The baffle has a configuration designed to produce a wide flame. A baffle of this type insures that the main burners are reliably ignited while forming a stabilized wide flame even at high gas flow rates. The ignition burner is rendered inoperative after the main burners have been reliably ignited. The entire ignition system is brought into a position in which it is not damaged by excessive thermal loading or by liquid slag during full-load operation of the gasifier closely adjacent the inside wall of the slag discharge pipe.

These features and advantages of the present invention as well as others will be more readily understood when the following description is read in light of the accompanying drawings, in which.

Figure 1:
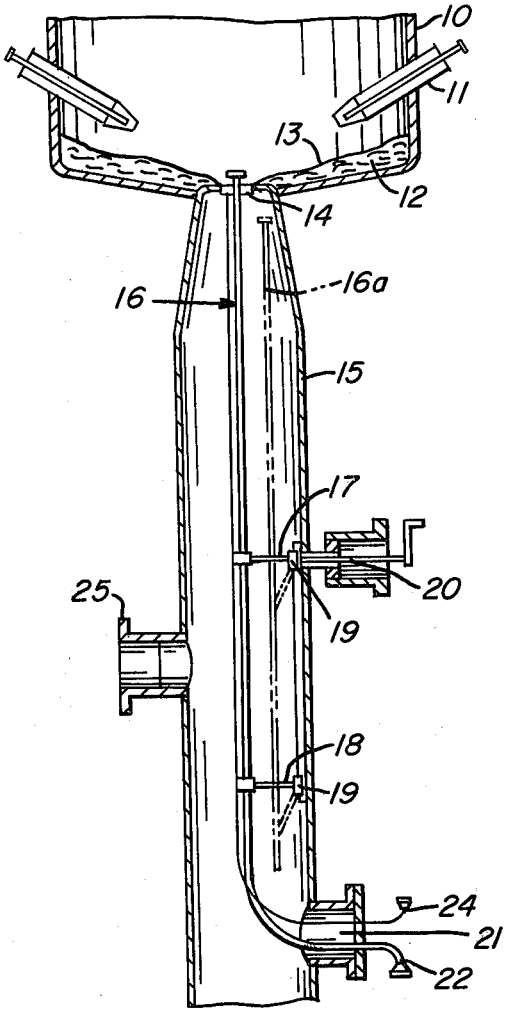
FIG. 1 is an elevational view, in section, through the bottom part of a fluidized stream gasifier illustrating the arrangement of parts forming the ignition system of the present invention.

The ignition system of the present invention is employed for use with slag bath generators of the type which are well known in the art per se. As shown in FIG. 1, a reaction chamber wall 10 forms part of such a well-known slag bath generator. Coolant tubes, not shown, usually extend along the walls of the slag bath generator. Main burners 11 extend downwardly at an angle through the wall 10 for feeding a gasifying agent and fine-particle fuel into the slag bath generator. A slag bath 12 is formed when the reactor or gasifier is in continuous operation. Reference numeral 13 denotes the level of the slag bath as determined by the position of an aperture 14 of an elongated slag overflow pipe 15 through which slag is discharged from the reactor. The lower end of the slag discharge pipe 15 communicates with a water bath where the liquid slag undergoes granulation for discharge through a lock system.

Figure 2:
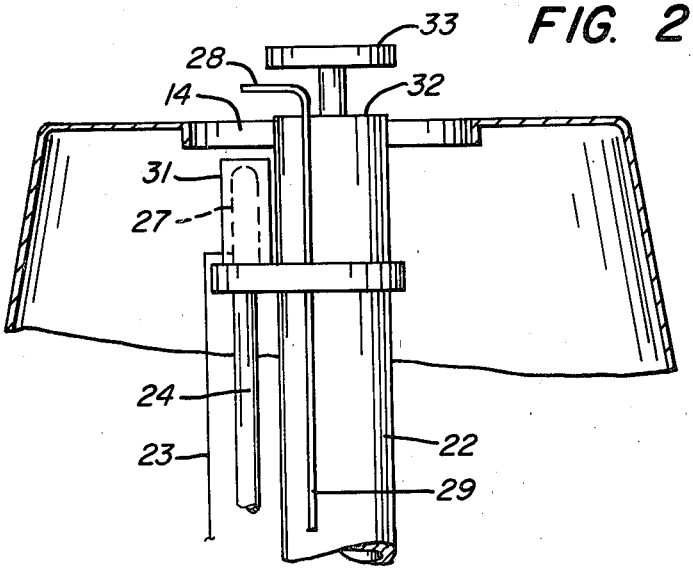
FIG. 2 is an enlarged view of the ignition system shown in FIG. 1.

An ignition system 16, the construction of which is best illustrated in FIG. 2, includes a pilot burner 31, a thermocouple forming a flame monitor 28, an ignition member 27, such as a sparkplug, an ignition burner 32 and a baffle 33. The ignition system further includes a fuel supply pipe 24 and an ignition cable 23. In FIG. 1, the ignition system 16 is shown in its operative position while a phantom-line position of the parts indicates at 16A the inoperative position. In the inoperative position, the ignition system is adequately protected from the flow of slag within the slag discharge pipe 15.

The ignition system 16 is supported by an upper lever 17 and a lower lever 18 by pivotal mountings 19 on the wall of the slag overflow pipe 15. The top pivotal mounting is connected to an actuating lever 50 by means of a connector rod or shaft which extends through the side wall of the slag overflow pipe 15 in a pressure-tight relationship. The actuating lever is operated from a position externally of the slag discharge pipe.

An aperture 21 in the side wall of the slag overflow pipe 15 is used for the external passage of the ignition cable 23, the fuel supply pipe 24 for the pilot burner 31, the fuel supply pipe 22 for the ignition burner 32, and a monitor cable 29 for the flame monitor 28. In FIG. 1, reference numeral 25 denotes an aperture in the side wall of the slag discharge pipe 15. The aperture 25 is used to introduce air for combustion with the fuel gas to produce the ignition flame.

After ignition has taken place in the slag bath generator, the ignition system is moved into a lateral position by means of the actuating lever 50 and apertures 21 and 25 are closed by blanking flanges.

Figure 5:
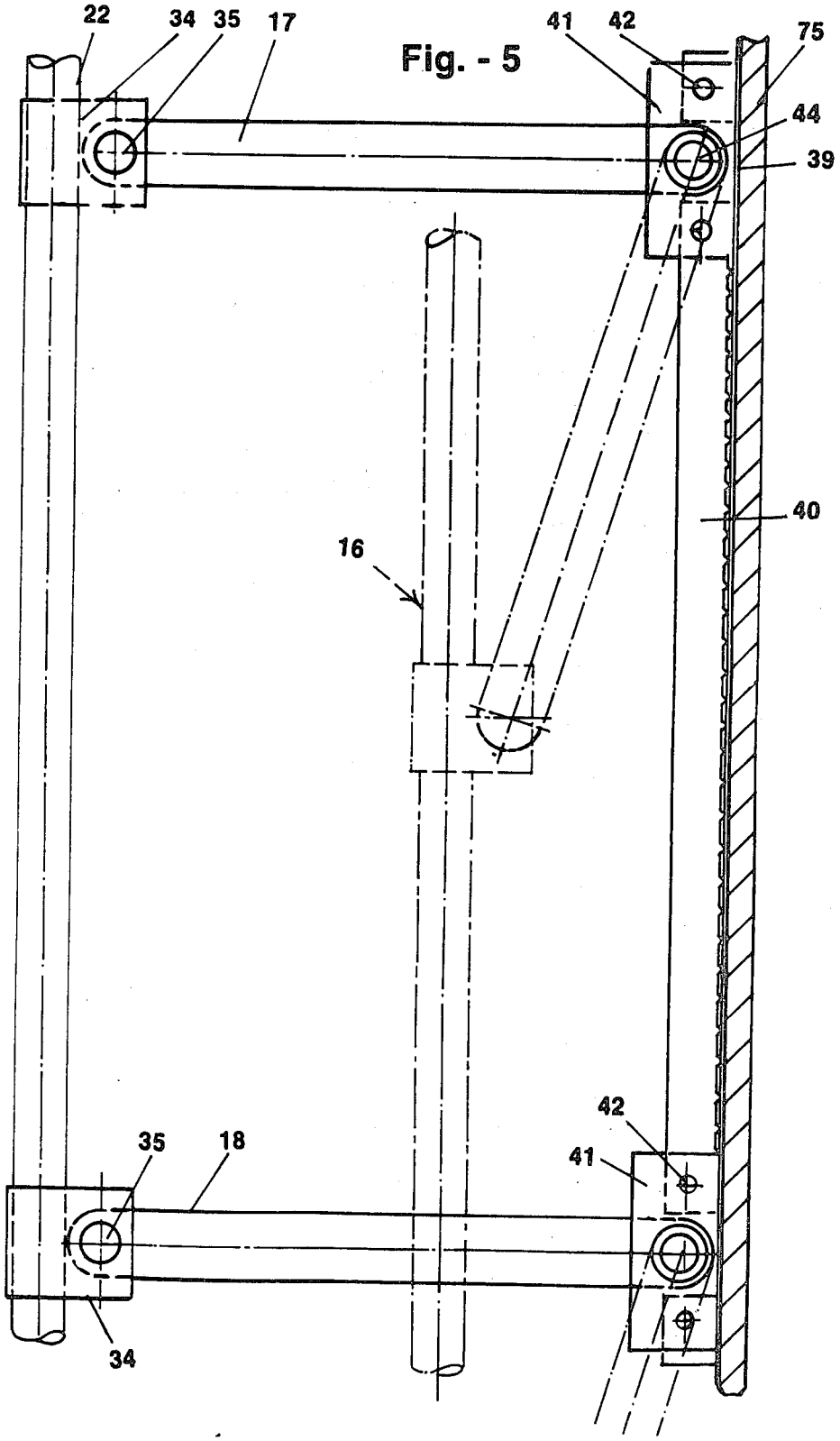
FIG. 5 is a sectional view taken along line V—V of FIG. 3.

As shown in FIGS. 1 and 5, the upper lever 17 and the lower lever 18 are each pivotally hinged at one end to the fuel supply pipe 22 at spaced-apart locations. The pivotal hinges at each location consist of a sheet metal member 34 that is bent into a U-shaped form and welded or otherwise attached onto the outer surface of the fuel supply pipe 22. A pivot pin 35 is passed through bored openings in the projected ends of the U-shaped member 34 and a bored opening in one end of the pivot lever. Spacers 36 mounted on the pin prevent undue clearances in the hinge. The pivot pin 35 includes a head portion at one end and a bored opening at its opposite end that receives a split pin 38 to hold a retainer washer 37 on pin 35 between the pin 38 and the U-shaped member 34. The pivot axis formed by each pivot pin 35 is transverse to the extended length of the slag overflow pipe.

Figure 3:
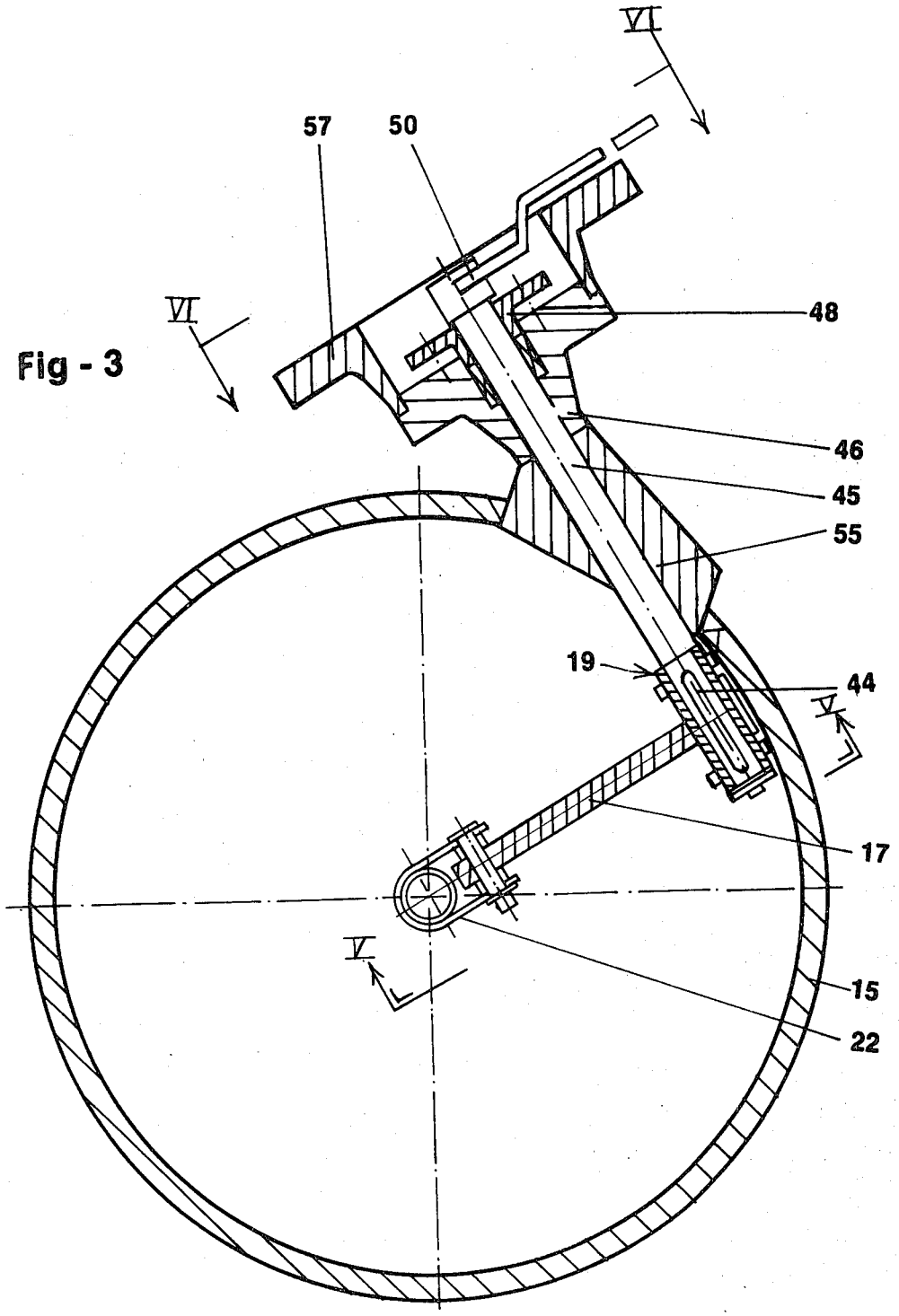
FIG. 3 is a sectional view taken along line III—III of FIG. 1.
Figure 4:
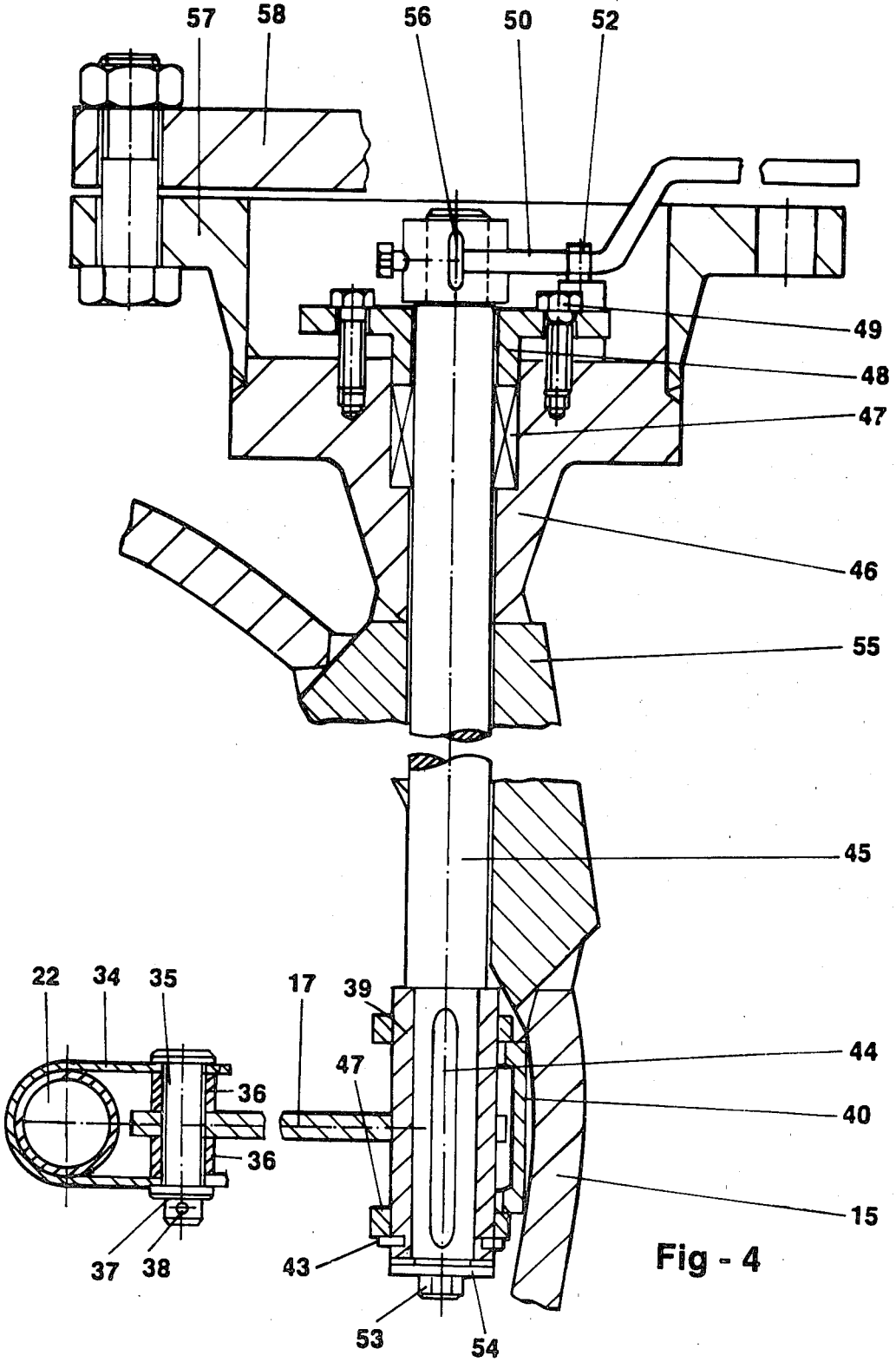
FIG. 4 is an enlarged view of the pivot and lever support for the burners of the ignition system shown in FIGS. 1 and 3.

As shown in FIGS. 3–5, the free ends of the upper lever 17 and the lower lever 18 are pivotally mounted onto the inside wall surface of the slag overflow pipe by the pivotal mountings 19 at spaced-apart locations corresponding to the space between the pivot pins 35. Each pivotal mounting includes a sleeve 39 welded onto the free end of the lever. Base plates 41 are mounted onto the sleeve at spaced-apart locations as shown in FIG. 4. The base plates are attached by screws 42 to a metal frame 40 which is welded onto the inside wall surface of the slag overflow pipe 15. A shaft 45 is coupled to the sleeve 39 by a key 44. A support 43 prevents longitudinal movement in the direction of the rotational axis of shaft 45. Such a support is typically in the form of a split collar that is moved into and held within a recess provided in the sleeve so that a projecting portion of the collar engages a base plate 41, as shown in FIG. 4. A screw 53 holds a washer 54 onto the end of the shaft within the slag overflow pipe to retain the shaft 45 on the sleeve 39. A support block 55 is welded to the side wall of the slag overflow pipe at an opening which is arranged so that the shaft 45 passed into an opening in the block extends, with respect to its rotational axis, transversely to the extended length of the slag overflow pipe and the flow direction of slag through the pipe. A flange 46 is welded onto the support 55 so that the opening therein receives the shaft 45. The flange 46 is constructed to form a stuffing box that includes a recess containing a filling of stuffing material indicated in FIG. 4 by reference numeral 47. A gland 48 is attached by bolts 49 to apply pressure to the stuffing material to form a pressure-tight seal between the shaft 45 and the flange 46. The actuating lever 50 is attached to the end of shaft 45 externally of the slag overflow pipe in a torque-transmitting relation by a key 56. Mounted on the flange 46 is a spring-loaded pin 52 to engage in a hole in the actuating lever 50 when the lever is positioned for locating the ignition system in its operative position. A blanking flange 57 is welded to flange 46. Flange 57 serves in conjunction with a blanking flange 58 to seal-off the opening through which the shaft extends externally of the slag discharge pipe while the coal gasifier is operating. In this case, the lever 50 is removed from the end of the shaft.

Figure 6:
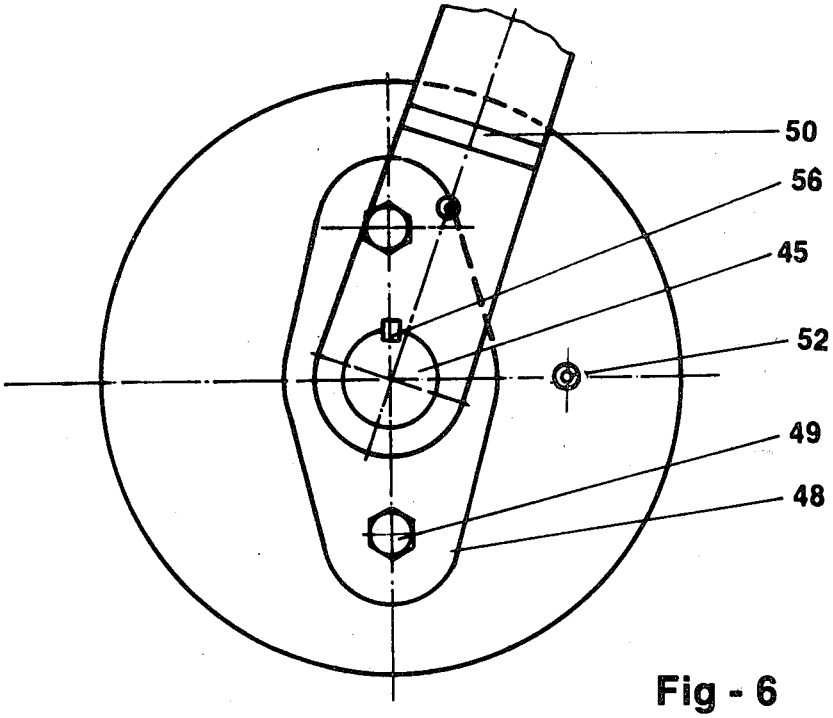
FIG. 6 is an elevational view taken along line VI—VI of FIG. 3 and illustrating the adjusting lever in the position for the non-operative positioning of the ignition system.
Figure 7:
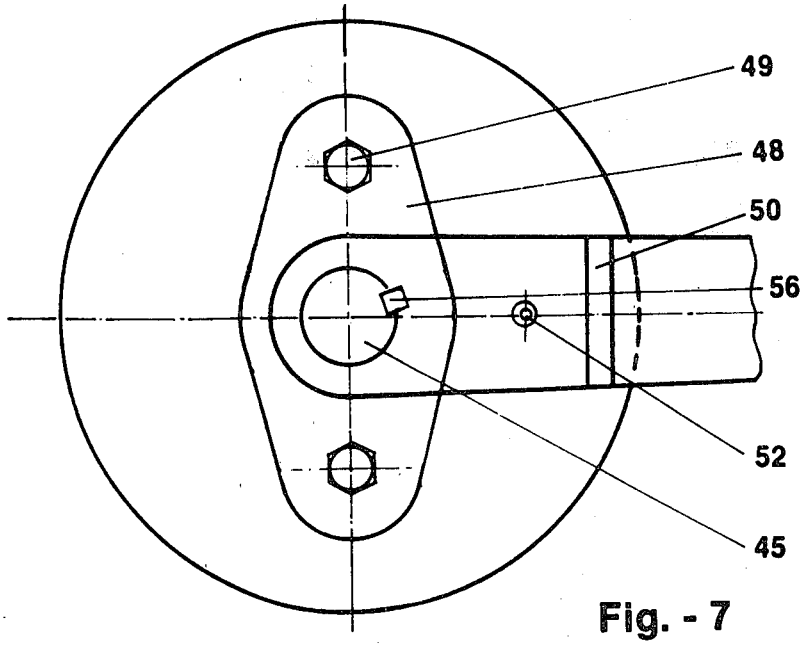
FIG. 7 is a view similar to FIG. 6 but illustrating the operative positioning of the ignition system adjustment lever.

FIG. 6 of the drawings illustrates the remote positioning of the ignition system by lever 50 in which case the lever 50 is angularly displaced from the site of the spring-loaded pin 52. The operative position of the ignition system occurs by moving the lever 50 in a position where the spring-loaded pin engages in the opening in the lever as shown in FIG. 7. In this position, the parts of the mechanical positioning structure are locked by the spring-loaded pin 52 to maintain the ignition system at a location in the slag discharge opening as shown in FIG. 1 for igniting the fluidized stream of finely-divided or powdered coal. It is to be understood that only one lever 50 is needed to position the ignition system. Therefore, one of the two shafts 45 is covered and sealed in a pressure-tight manner by the blanking flanges 57 and 58.

In view of the foregoing, it is now apparent that the ignition burner, pilot burner and fuel supply pipes are moved between the operative and inoperative positions within substantially only one plane that is diametrical to and parallel with the slag discharge pipe. Moreover, this movement is about an arcuate path that always changes the elevation and spacing of the burners with respect to the slag discharge opening in the pipe 15.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. An ignition system for a fluidized stream of finely-divided coal particles in a pressurized gasifier housing having a slag overflow pipe coupled to a discharge vessel, said ignition system including the combination of:

an ignition burner arranged in said slag overflow pipe to ignite the fluidized streams of finely-divided coal particles within said gasifier housing, a pilot burner supported to ignite said ignition burner, fuel supply pipe means to deliver fuel for combustion by said ignition burner and said pilot burner, ignition means to ignite fuel delivered by said fuel supply pipe to said pilot burner, at least one support lever supported on said slag overflow pipe by a pivot extending transversely to the extended length of said slag overflow pipe, said support lever carrying said ignition burner, ignition means, fuel supply pipe and pilot burner for movement between an operative position wherein said ignition burner is situated at the slag-receiving opening of said slag overflow pipe and an inoperative position remote from the slag-receiving opening where said ignition burner is protected from contact by slag and radiation heating, said at least one support lever moves said ignition burner within substantially only one plane extending through the centerline of said slag overflow pipe, and means carried by said slag overflow pipe to form a pressure-tight mechanical connection for external passage of at least one of said support levers from said slag overflow pipe.

2. The ignition system according to claim 1 further including monitor means for the flame developed by said pilot burner, cable means for said ignition means, and a flanged cover fixed in a pressure-tight relation to said slag overflow pipe for external passage of said fuel supply pipe, cable means and monitor means from said slag overflow pipe.

3. The ignition system according to claim 1 further including monitor means for the flame developed by said pilot burner, and wherein said pilot burner is disposed on said ignition burner.

4. The ignition system according to claim 3 wherein said ignition means includes a sparkplug.

5. The ignition system according to claim 3 wherein said ignition means includes a hot-wire igniter.

6. The ignition system according to claim 1 further including a baffle in front of said ignition burner for the production of a wide ignition flame.

7. The ignition system according to claim 1 wherein said at least one lever includes a pair of levers carried by pivots on the inner wall of said slag overflow pipe.

8. The ignition system according to claim 1 wherein said at least one support lever includes upper and lower levers each having a pivot at their opposite ends wherein said pivots are extending transversely to the extended length of said slag overflow pipe.

9. The ignition system according to claim 8 wherein said upper and lower levers are supported upon the inside wall of said slag overflow pipe.

* * * * *

UNITED STATES PATENT AND TRADEMARK OFFICE

CERTIFICATE OF CORRECTION

PATENT NO. : 4,372,754

DATED : February 8, 1983

INVENTOR(S) : Paul Gernhardt et al

It is certified that error appears in the above-identified patent and that said Letters Patent is hereby corrected as shown below:

On the title page add:

-- [30] Foreign Application Priority Data

December 16, 1977 [DE] Fed. Rep. of Germany ....2756138 --.

Signed and Sealed this

Fourth Day of October 1983

[SEAL]

*Attest:*

GERALD J. MOSSINGHOFF

*Attesting Officer*

*Commissioner of Patents and Trademarks*